US011759675B2

(12) United States Patent
Peterson

(10) Patent No.: US 11,759,675 B2
(45) Date of Patent: Sep. 19, 2023

(54) EXERCISE APPARATUS FOR TRAINING MUSCLES

(71) Applicant: Advanced Fitness Concepts, Inc., Charlotte, NC (US)

(72) Inventor: Cyrus Peterson, Charlotte, NC (US)

( * ) Notice: Subject to any disclaimer, the term of this patent is extended or adjusted under 35 U.S.C. 154(b) by 10 days.

(21) Appl. No.: 17/515,619

(22) Filed: Nov. 1, 2021

(65) Prior Publication Data

US 2022/0258003 A1 Aug. 18, 2022

Related U.S. Application Data

(60) Provisional application No. 63/150,625, filed on Feb. 18, 2021.

(51) Int. Cl.

| | |
|---|---|
| ***A63B 23/04*** | (2006.01) |
| ***A63B 21/06*** | (2006.01) |
| ***A63B 23/035*** | (2006.01) |
| ***A63B 21/00*** | (2006.01) |

(52) U.S. Cl.

CPC ..... *A63B 23/0482* (2013.01); *A63B 21/0615* (2013.01); *A63B 21/154* (2013.01); *A63B 21/4029* (2015.10); *A63B 21/4039* (2015.10); *A63B 23/03525* (2013.01); *A63B 2208/0261* (2013.01)

(58) Field of Classification Search

CPC ..... A63B 21/00047; A63B 21/008; A63B 21/0083; A63B 21/0615; A63B 21/0616; A63B 21/068; A63B 21/15; A63B 21/154; A63B 21/4009; A63B 21/4011; A63B 21/4027; A63B 21/4029; A63B 21/4031; A63B 21/4034; A63B 23/0233; A63B 23/03525; A63B 23/035

See application file for complete search history.

(56) References Cited

U.S. PATENT DOCUMENTS

| | | | | |
|---|---|---|---|---|
| 3,817,243 | A * | 6/1974 | Perrine | A63B 21/0615 601/24 |
| 4,422,636 | A * | 12/1983 | de Angeli | A63B 21/0617 482/99 |
| 4,848,739 | A * | 7/1989 | Schaub | A63B 21/00072 482/113 |
| 10,398,929 | B2 * | 9/2019 | Hsieh | A63B 21/4029 |
| D956,890 | S * | 7/2022 | Scott | D21/686 |
| 2009/0118104 | A1 * | 5/2009 | Chou | A63B 21/08 482/94 |

(Continued)

OTHER PUBLICATIONS

Rogue Fitness, Rogue Donkey [online], Published: Jun. 6, 2019; Retrieved from the Internet <URL: https://www.facebook.com/roguefitness/photos/a.128475269459/10158048258619460/?type=3&theater > (Year: 2019).*

*Primary Examiner* — Loan B Jimenez
*Assistant Examiner* — Zachary T Moore
(74) *Attorney, Agent, or Firm* — Law Office of Ilya Libenzon

(57) ABSTRACT

An exercise apparatus for training gluteus and hamstring muscles in accordance with the present disclosure is provided. The exercise apparatus includes a base, a hip pad pivotally connected to the base, a glute hamstring extension module configured to change the distance from the hip pad, and a reverse hyperextension module having a pendulum pivotally connected to the base.

14 Claims, 9 Drawing Sheets

(56) References Cited

U.S. PATENT DOCUMENTS

| | | | | |
|---|---|---|---|---|
| 2010/0125030 | A1* | 5/2010 | Shifferaw | A63B 23/0355 482/94 |
| 2014/0137912 | A1* | 5/2014 | Kline | A61H 3/04 135/67 |
| 2015/0011370 | A1* | 1/2015 | Henniger | A63B 23/0211 482/145 |
| 2019/0015695 | A1* | 1/2019 | Simmons | A63B 1/00 |
| 2021/0228937 | A1* | 7/2021 | Pence | A63B 23/0405 |

* cited by examiner

EXERCISE APPARATUS FOR TRAINING MUSCLES

CROSS-REFERENCE TO RELATED APPLICATIONS

This application claims the benefit of U.S. provisional patent application No. 63/150,625 filed on Feb. 18, 2021, the content of which is incorporated by reference in its entirety.

FIELD OF THE INVENTION

This invention relates to exercise machines and methods for training muscles, particularly the gluteus maximus and hamstring muscles.

BACKGROUND OF THE INVENTION

Physical performance depends heavily on the attributes of muscular development such as flexibility, strength, power, endurance, and neuromuscular control. The ultimate goal of developing these muscular attributes is to improve muscle performance. Training to improve running and jumping performance, rehabilitate injured knees, or prevent injuries to the lower leg involves activity specific training, and development of strength, power, and neuromuscular control. A variety of exercise devices have been developed to simulate activities found to be effective in conditioning the body. However, these machines are limited in their ability to provide users with a convenient exercise routine allowing users the flexibility to vary their lines of motion. Moreover, these prior art machines are expensive to maintain, difficult to operate and not reliable.

A continuing need, therefore, exists for improved exercise machines for training muscles. Such apparatuses should be designed to make the exercise process simpler, safer and more flexible. The present invention provides such an exercise apparatus, which is easy to operate, reliable and inexpensive to maintain.

SUMMARY OF THE INVENTION

An exercise apparatus for training gluteus and hamstring muscles in accordance with the present disclosure is provided. The exercise apparatus includes a base, a hip pad pivotally connected to the base, a glute hamstring extension module configured to change the distance from the hip pad, and a reverse hyperextension module having a pendulum pivotally connected to the base.

In some instances, the exercise apparatus can further include one or more step brackets. It can also include one or more weight plate pegs. In some instances the base of the exercise machine can include a step plate. According to some embodiments of the present invention, the glute hamstring extension module can also include a pair of feet pads. In some instances, it can also include a feet plate and support bracket coupled to a pair of swivel arms and a locking plate.

Other aspects, embodiments and features of the device and method will become apparent from the following detailed description when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the device and method shown where illustration is not necessary to allow those of ordinary skill in the art to understand the device and method.

BRIEF DESCRIPTION OF THE DRAWINGS

The preceding summary, as well as the following detailed description of the disclosed system and method, will be better understood when read in conjunction with the attached drawings. It should be understood, however, that neither the system nor the method is limited to the precise arrangements and instrumentalities shown.

DETAILED DESCRIPTION OF SPECIFIC EMBODIMENTS

An exercise apparatus for training gluteus and hamstring muscles in accordance with the present disclosure is provided. The exercise apparatus is characterized in that it's inexpensive, easy to operate and effective in allowing users the flexibility to vary their lines of motion.

Figure 1:
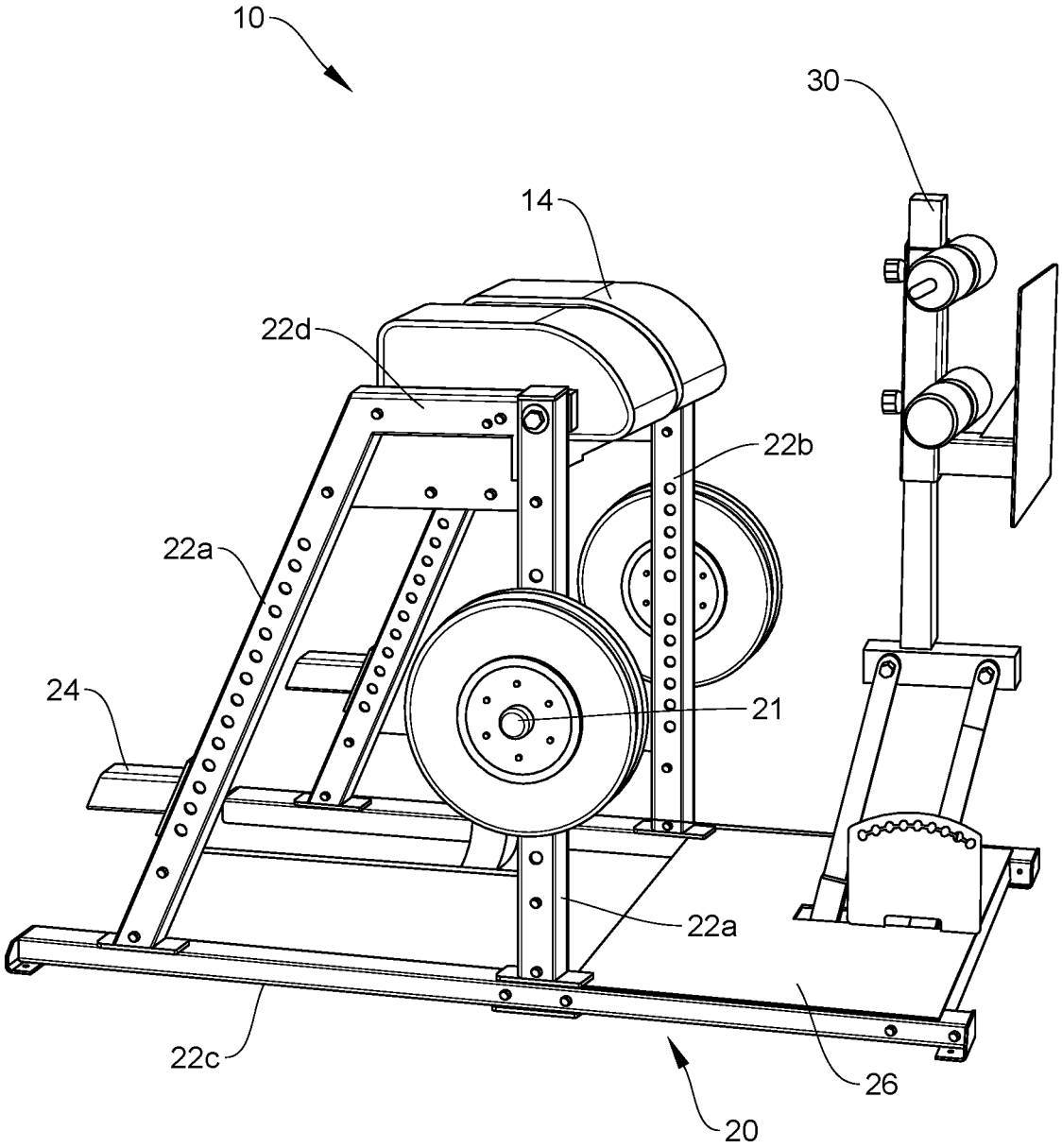
FIG. 1 is an exploded front view of the exercise machine in accordance with an embodiment of the present disclosure.
Figure 8:
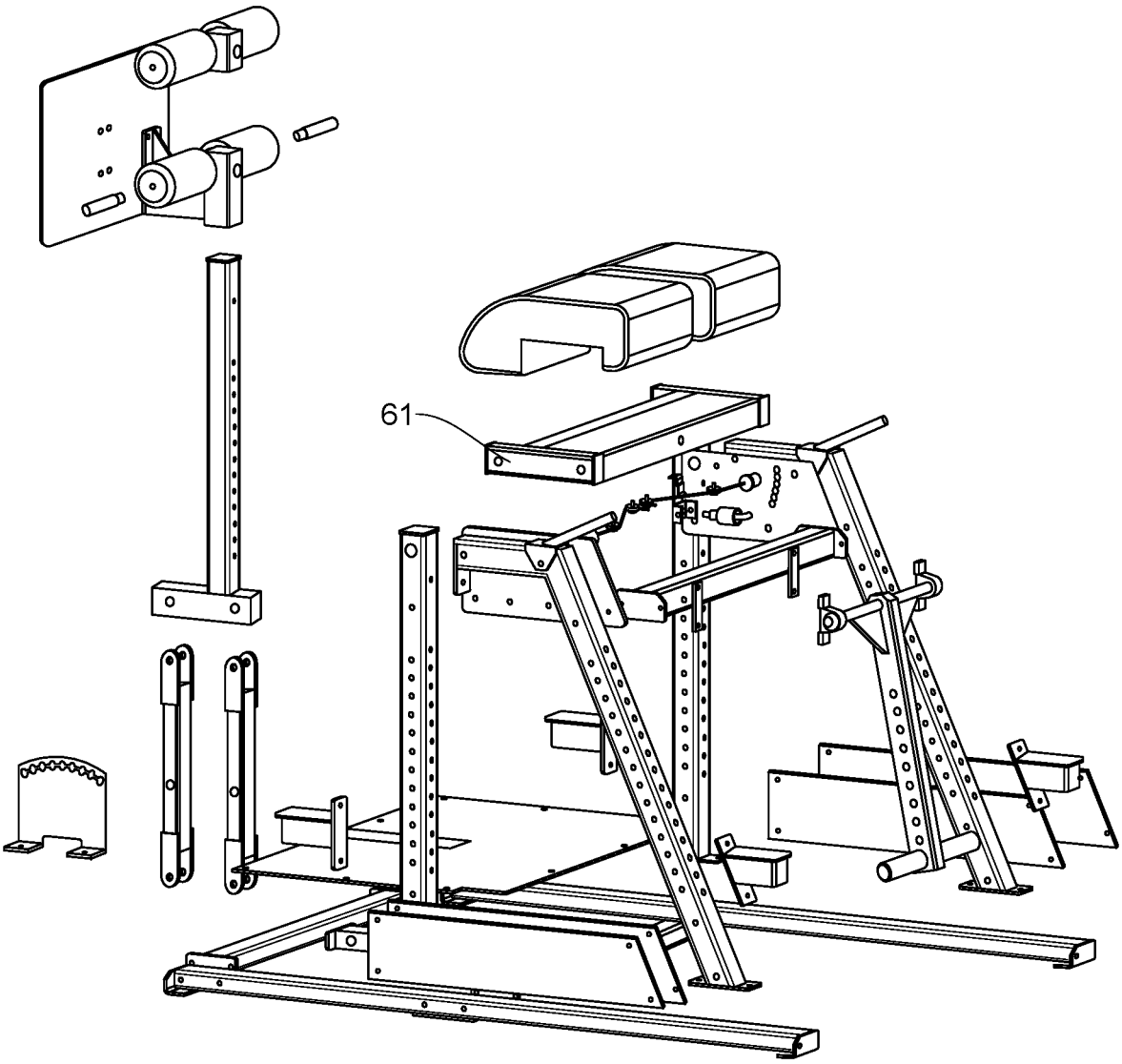
FIG. 8 shows the exercise machine of the present invention in a disassembled state.
Figure 9:
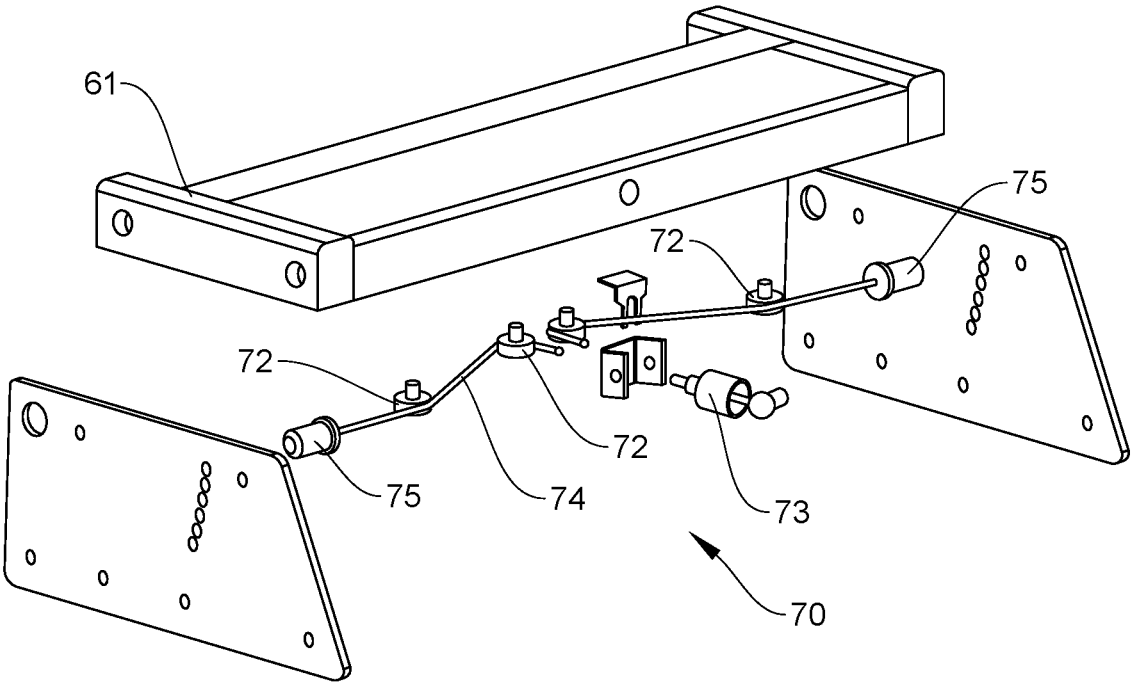
FIG. 9 is a schematic illustration of the pulley and cable hip pad locking mechanism.

As illustrated in FIG. 1, exercise apparatus 10 includes base 20 having a pair of front upright support brackets 22*a*, a pair of back upfront brackets 22*b*, a pair of bottom horizontal support brackets 22*c*, and a pair of top horizontal support brackets 22*d*. In some instances, the base 20 can also include step plate 26 disposed on a portion of horizontal support brackets 22*c*. The exercise apparatus can also include one or more weight plate pegs 21 for storing one or more weight plates. The exercise apparatus 10 also includes hip pad 14 disposed between and coupled to top horizontal support brackets 22*d* and glute hamstring extension module 30 disposed at a distance from back upfront brackets 22*b*. In some embodiments, the exercise machine of the present disclosure can include one or more step brackets 24 disposed on the front upright support brackets 22*a*. In some instances, the hip pad 14 is mounted on the hip pad support member 61 (as shown in FIGS. 8-9) that is pivotally connected to the top horizontal support brackets 22*d*.

Figure 2:
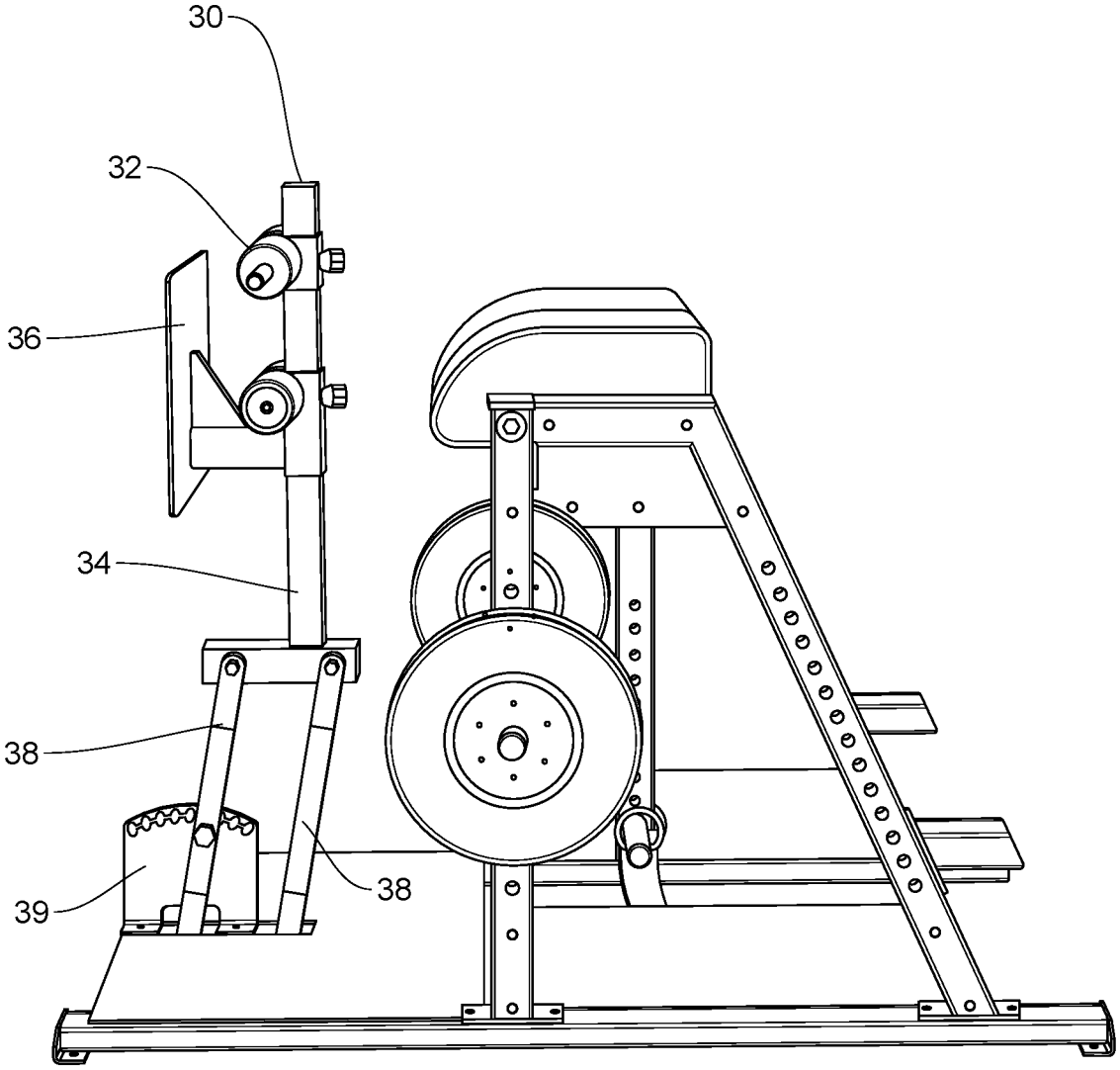
FIG. 2 is an exploded back view of the exercise machine in accordance with an embodiment of the present disclosure.
Figure 7A:
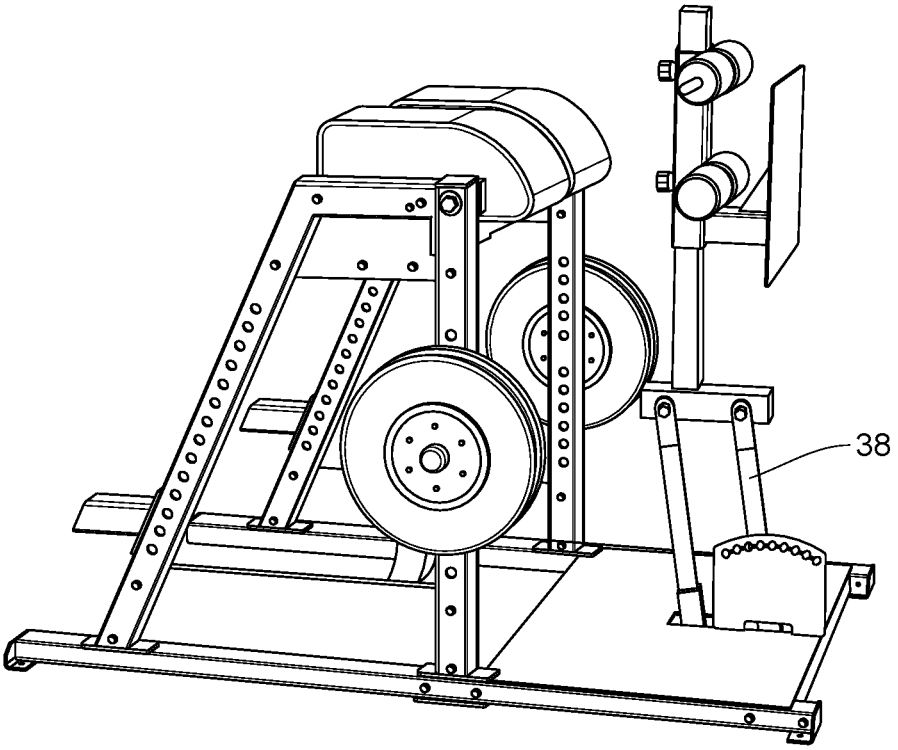
FIGS. 7A and 7B illustrate the range of motion of the fee pad swivel arms of the glute hamstring extension module in accordance with an embodiment of the present invention.
Figure 7B:
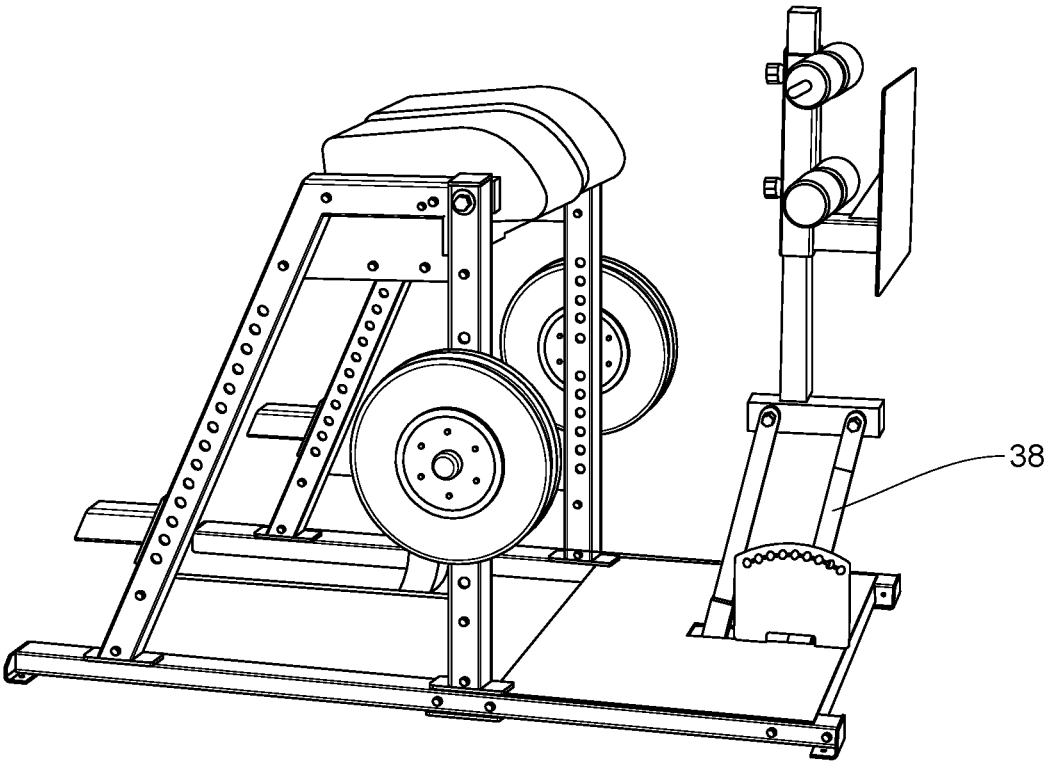

As illustrated in more detail in FIG. 2, the glute hamstring extension module 30, includes at least one pair of feet pads 32 coupled to a support bracket 34 which is coupled to the base 20. In some instances, the module 30 can further include feet plate 36 attached to the feet pad support bracket 34. In some embodiments of the present invention, the glute hamstring extension module 30 is configured to change the distance from the back upfront brackets 22*b* by virtue of a pair of feet pad swivel arms 38 connected to the feet pad support bracket 34 and locking plate 39 and pivotally connected to the base 20. The locking plate 39 has a plurality of openings to receive a locking pin and thereby fixing the feet pad support structure at a particular distance from the back upfront brackets 22*b* as also illustrated in FIGS. 7A-7B. The pair of feet pads 32 can be mounted at different heights along the feet pad support bracket 34 using a locking pin.

Figure 3:
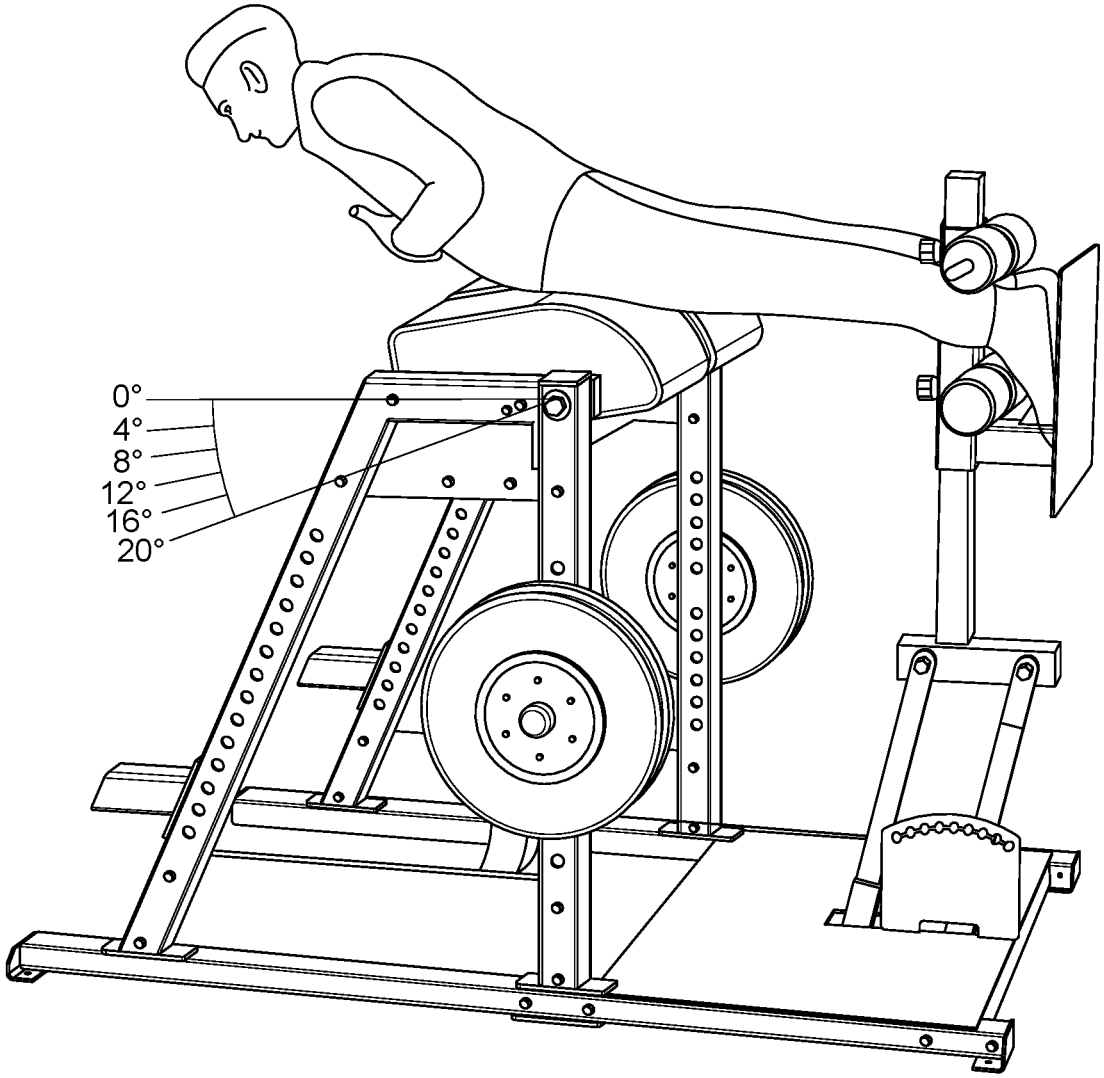
FIG. 3 is a schematic illustration of the exercise machine in use utilizing the glute hamstring extension module.

FIG. 3 shows the glute hamstring extension module in use, wherein the hip pad 14 can be positioned at various angles in 4-degree increments, for example. The hip pad 14 is pivotally coupled to the top horizontal brackets by virtue of pulley and cable system 70 that includes a plurality of guide pulleys 72 (or sprockets, spools or the like), a puller 73 and a cable 74 connected to a locking piston 75 configured to lock the hip pad 14 at a particular angle by sliding in and out of the openings disposed in the top horizontal bracket 22*d* when the cable 74 is pulled by the puller 73, as also illustrated in FIG. 8 and FIG. 9 in more detail. The hip pad 14 can be pivotally connected to the base 20 using a different mechanism. The hip pad 14 can be connected to a rod that is pivotally attached to the base 20 by top horizontal brackets and configured to rotate about an axis of rotation at various angles in increments. It can further be configured to be fixable at each particular angle of rotation using a locking pin, for example, or any other suitable locking mechanism. According to some embodiments of the present invention, the hip pad 14 can be fixedly attached to the base at a particular angle.

Figure 4:
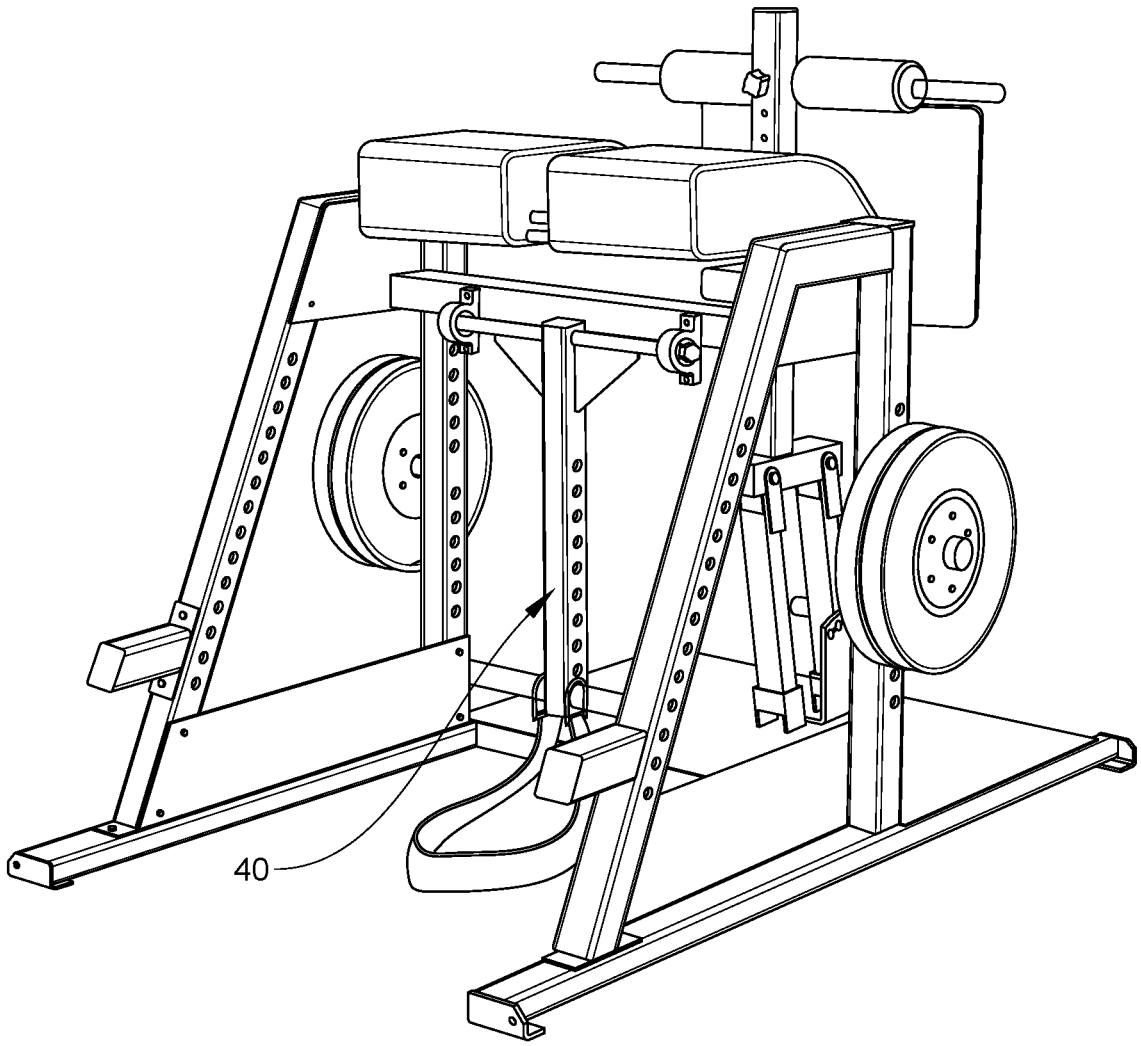
FIG. 4 is a depiction of the exercise machine of the present invention showing the reverse hyperextension module.
Figure 5:
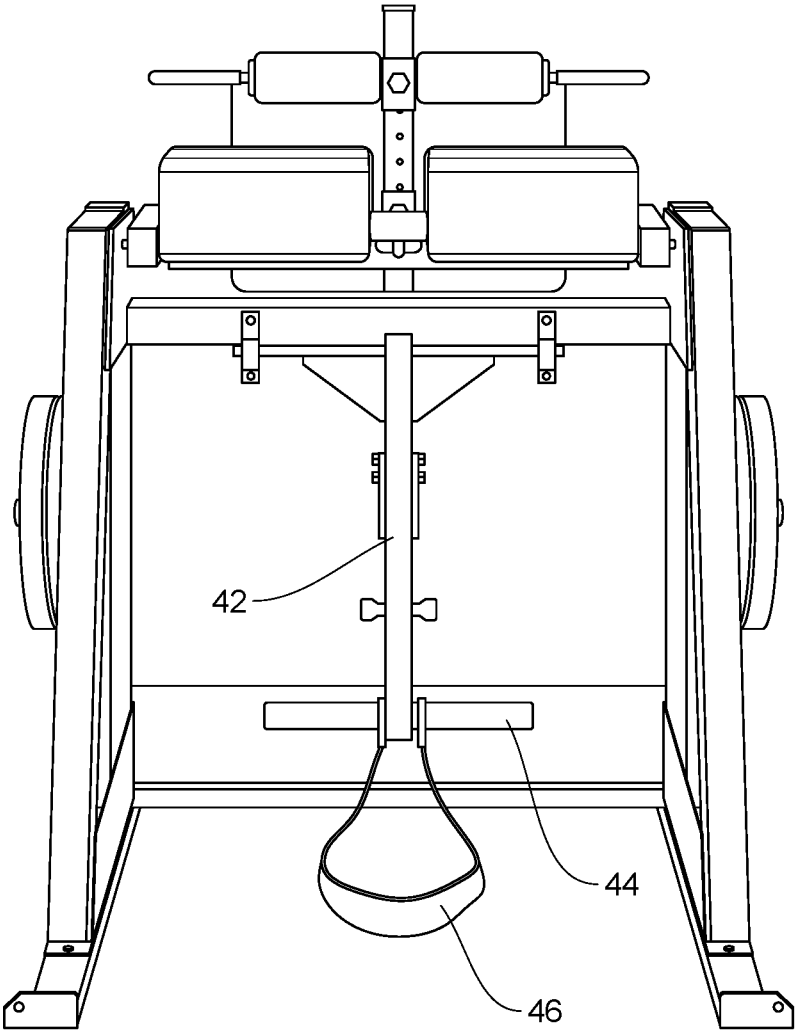
FIG. 5 is a more detailed illustration of the reverse hyperextension module.
Figure 6:
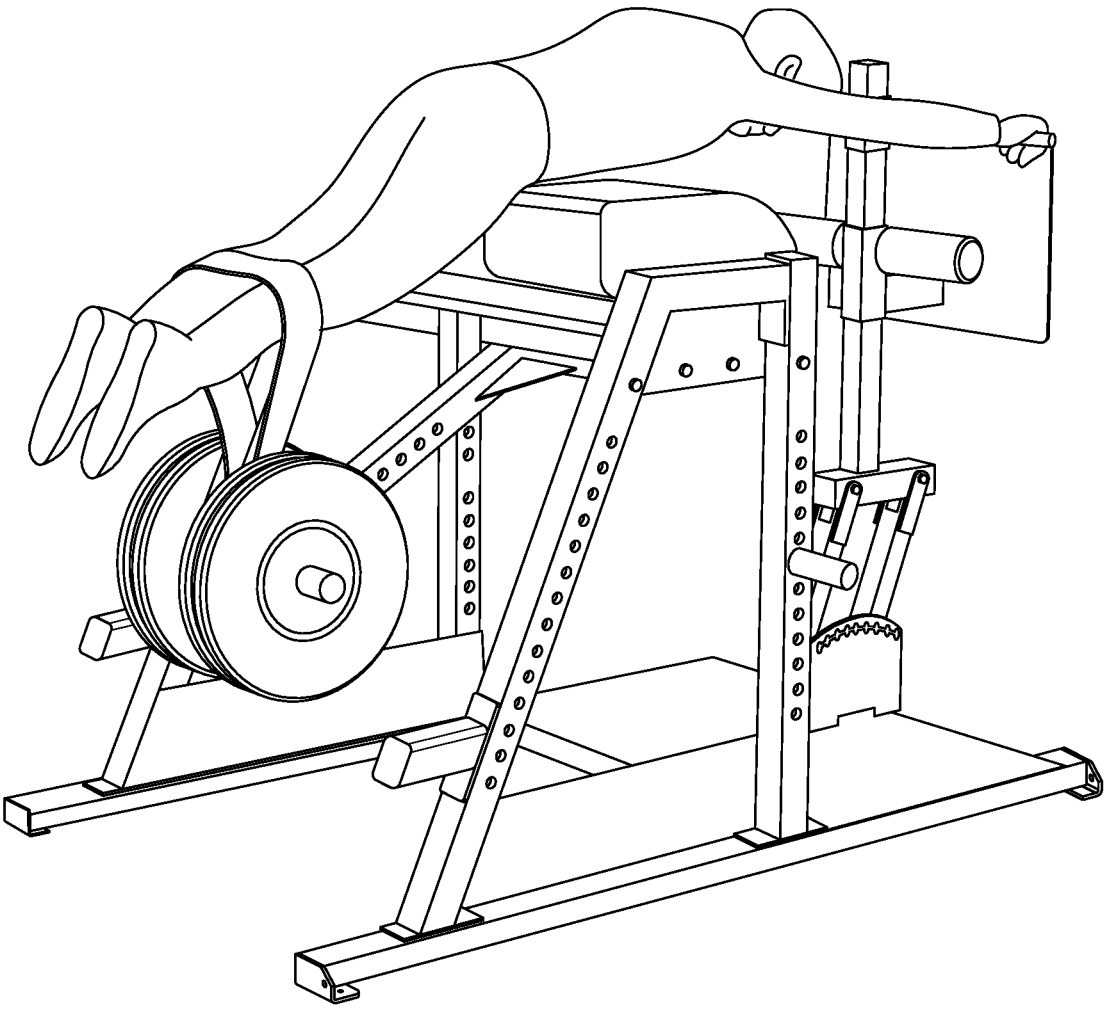
FIG. 6 is a schematic illustration of the exercise machine in use utilizing the reverse hyperextension module.

As illustrated in FIGS. 4-5, the exercise apparatus of the present invention also includes reverse hyperextension module 40 having reverse hyperextension pendulum 42, one or more pendulum weight pegs 44 and pendulum weight plate harness 46. The pendulum 42 is pivotally connected to the base 20 by a top horizontal bracket and configured to rotate about an axis of rotation by virtue of one or more bearings disposed on the pendulum 42. The reverse hyperextension module in use is illustrated in FIG. 6.

The various parts of the exercise machine of the present disclosure can be made of different materials such as metal, plastic, rubber, steel, wood, carbon fiber, or combination thereof.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

The foregoing detailed description is merely exemplary in nature and is not intended to limit the invention or application and uses of the invention. Furthermore, there is no intention to be bound by any expressed or implied theory presented in the preceding technical field, background, brief summary, or the following detailed description.

What is claimed is:

1. An exercise apparatus for training muscles comprising:
a base;
a hip pad pivotally connected to the base;
a glute hamstring extension module configured to change position relative to the hip pad; and
a reverse hyperextension module having a pendulum pivotally connected to the base;
wherein the base is formed by a pair of front upright support brackets, a pair of back upfront brackets, a pair of bottom horizontal support brackets and a pair of top horizontal support brackets; and wherein the hip pad is pivotally coupled to the top horizontal brackets by virtue of a pulley and cable system that includes at least one guide pulley, a puller and a cable connected to one or more locking pistons configured to lock the hip pad at a particular angle by sliding in and out of openings disposed in the top horizontal bracket when the cable is pulled by the puller.

2. The exercise apparatus of claim 1, further comprising one or more step brackets connected to the base.

3. The exercise apparatus of claim 1, further comprising one or more weight plate pegs connected to the base.

4. The exercise apparatus of claim 1, further comprising a step plate connected to the base.

5. The exercise apparatus of claim 1, wherein the glute hamstring extension module further comprises a pair of feet pads.

6. The exercise apparatus of claim 1, wherein the glute hamstring extension module further comprises a feet plate and a support bracket coupled to a pair of swivel arms and a locking plate.

7. The exercise apparatus of claim 6, wherein the locking plate has a plurality of openings to receive a locking pin and thereby fixing the position of the glute hamstring extension module relative to the back upfront brackets.

8. The exercise apparatus of claim 1, further comprising a pair of weight plate pegs attached to a distal end of the pendulum.

9. The exercise apparatus of claim 1, further comprising a weight plate harness attached to a distal end of the pendulum.

10. The exercise apparatus of claim 1, wherein the hip pad is mounted on a hip pad support member pivotally connected to the top horizontal support brackets.

11. The exercise apparatus of claim 1, wherein the hip pad is connected to a rod pivotally attached to the base by the top horizontal brackets and configured to rotate about an axis of rotation at the particular angles.

12. The exercise apparatus of claim 1, wherein the hip pad is configured to be fixable at the particular angles of rotation using a locking pin.

13. The exercise apparatus of claim 1, wherein the pendulum is pivotally connected to the base by the top horizontal brackets and configured to rotate about an axis of rotation by virtue of one or more bearings disposed on the pendulum.

14. The exercise apparatus of claim 1, wherein the hip pad is fixedly attached to the base at the particular angles.

* * * * *